US006742312B2

(12) United States Patent
Valentine

(10) Patent No.: US 6,742,312 B2
(45) Date of Patent: Jun. 1, 2004

(54) SHOCK ABSORBER FOR SPORTS FLOOR

(75) Inventor: Jim Louis Valentine, Glenroe, OK (US)

(73) Assignee: Citizens State Bank, Morrison, OK (US)

( * ) Notice: Subject to any disclaimer, the term of this patent is extended or adjusted under 35 U.S.C. 154(b) by 0 days.

(21) Appl. No.: 10/131,804

(22) Filed: Apr. 23, 2002

(65) Prior Publication Data

US 2002/0178675 A1 Dec. 5, 2002

Related U.S. Application Data

(60) Provisional application No. 60/286,443, filed on Apr. 25, 2001.

(51) Int. Cl.[7] ..... E04F 15/22

(52) U.S. Cl. ..... 52/403.1; 52/480; 248/632; 248/634

(58) Field of Search ..... 52/403.1, 480, 52/479, 481.1, 481.2; 248/615, 616, 634, 635, 632, 633, 618, 560

(56) References Cited

U.S. PATENT DOCUMENTS

| | | | | |
|---|---|---|---|---|
| 216,656 | A | | 6/1879 | Chase |
| 498,344 | A | | 5/1893 | Williams |
| 638,997 | A | | 12/1899 | Stock |
| 863,054 | A | | 8/1907 | Dickerson |
| 895,215 | A | | 8/1908 | Vogel |
| 1,137,138 | A | | 4/1915 | Heron |
| 1,356,797 | A | | 10/1920 | Stock |
| 1,356,798 | A | | 10/1920 | Stock |
| 1,477,331 | A | | 12/1923 | Ely |
| 1,734,727 | A | | 11/1929 | Herold |
| 1,757,518 | A | | 5/1930 | Ehmer |
| 1,789,576 | A | | 1/1931 | Bowman |
| 2,167,696 | A | | 8/1939 | Tetzman |
| 2,569,709 | A | | 10/1951 | Elmendorf |
| 2,862,255 | A | | 12/1958 | Nelson |
| 2,893,665 | A | | 7/1959 | Paulsen |
| 3,107,377 | A | | 10/1963 | Nathan |
| 3,273,296 | A | | 9/1966 | Soulon |
| 3,288,405 | A | | 11/1966 | Johnson |
| RE26,239 | E | | 7/1967 | Rockabrand et al. |
| 3,337,167 | A | | 8/1967 | Johnson |
| 3,368,806 | A | | 2/1968 | Szonn |
| 3,417,950 | A | | 12/1968 | Johnson |
| 3,601,345 | A | | 8/1971 | Johnson |
| 3,604,173 | A | | 9/1971 | Dahlborg |
| 4,302,552 | A | | 11/1981 | Hongu et al. |
| 4,589,243 | A | | 5/1986 | Abendroth |
| 4,616,462 | A | | 10/1986 | Abendroth |
| 4,703,601 | A | | 11/1987 | Abendroth |
| 4,879,857 | A | * | 11/1989 | Peterson et al. ..... 52/403.1 |
| 4,890,434 | A | * | 1/1990 | Niese ..... 52/393 |
| 4,945,697 | A | * | 8/1990 | Ott et al. ..... 52/403.1 |
| 5,277,010 | A | * | 1/1994 | Stephenson et al. ..... 52/403.1 |
| 5,412,917 | A | * | 5/1995 | Shelton ..... 52/403.1 |
| 5,609,000 | A | * | 3/1997 | Niese ..... 52/480 |
| 5,619,832 | A | * | 4/1997 | Myrvold ..... 52/403.1 |
| 6,141,931 | A | * | 11/2000 | Simmons ..... 52/480 |
| RE37,615 | E | * | 4/2002 | Niese ..... 52/480 |
| 6,363,675 | B1 | * | 4/2002 | Shelton ..... 52/403.1 |
| 6,397,543 | B1 | * | 6/2002 | Hamar ..... 52/403.1 |

FOREIGN PATENT DOCUMENTS

| | | |
|---|---|---|
| GB | 18992 | 8/1909 |
| GB | 23589 | 10/1913 |
| GB | 242924 | 8/1925 |

* cited by examiner

*Primary Examiner*—Jeanette Chapman
(74) *Attorney, Agent, or Firm*—Dunlap Codding & Rogers

(57) ABSTRACT

A shock absorber for a sports floor assembly. The shock absorber has a base portion and a nodule portion. The base portion is formed of an elastomeric material. The nodule portion extends a distance from one side of the base portion and has a first layer formed of an elastomeric material with a durometer Shore hardness substantially equal to the durometer Shore hardness of the base portion. The nodule portion has a second layer formed of an elastomeric material having a durometer Shore hardness less than the durometer Shore hardness of the base portion and the first layer of the nodule portion.

33 Claims, 2 Drawing Sheets

SHOCK ABSORBER FOR SPORTS FLOOR

CROSS REFERENCE TO RELATED APPLICATIONS

This application claims the benefit of U.S. Provisional Application Serial No. 60/286,443, filed Apr. 25, 2001, which is expressly incorporated herein by reference.

BACKGROUND OF THE INVENTION

1. Field of the Invention

The present invention relates generally to a shock absorber, and more particularly, but not by way of limitation, to an improved shock absorber for a sports floor.

2. Brief Description of the Related Art

It is generally known to provide cushioning pads under a sports flooring system in order to provide resiliency to the floor. In such known systems, the amount of cushioning provided by the pads is generally controlled by the durometer, i.e., the hardness of the pads. There are both advantages and disadvantages to using either hard or soft pads.

Specifically, in sports such as basketball and racquetball, it is important that the floor be relatively stiff, so that the ball bounces back easily and uniformly throughout the floor. High durometer (hard) resilient pads produce a floor having preferred ball response characteristics. However, hard pads provide little shock absorption, and have a greater potential to cause injury to the athlete. This problem is especially severe when heavy loading occurs from a number of athletes performing in close proximity to each other.

Low durometer (soft) resilient pads provide greater shock absorption and hence provide a higher level of safety or protection to the athlete. However, floors employing such soft pads do not produce desirable ball response characteristics under normal loading conditions, and thus are not suitable for sports such as basket ball and racquetball. Furthermore, soft pads are prone to "compression set" which is a permanent change in profile after the pad has been subjected to high loads for a long period of time. Such compression set can occur in areas where bleachers, basketball standards, or other gymnasium equipment are likely to be placed for periods of time.

DETAILED DESCRIPTION OF THE INVENTION

Figure 1:
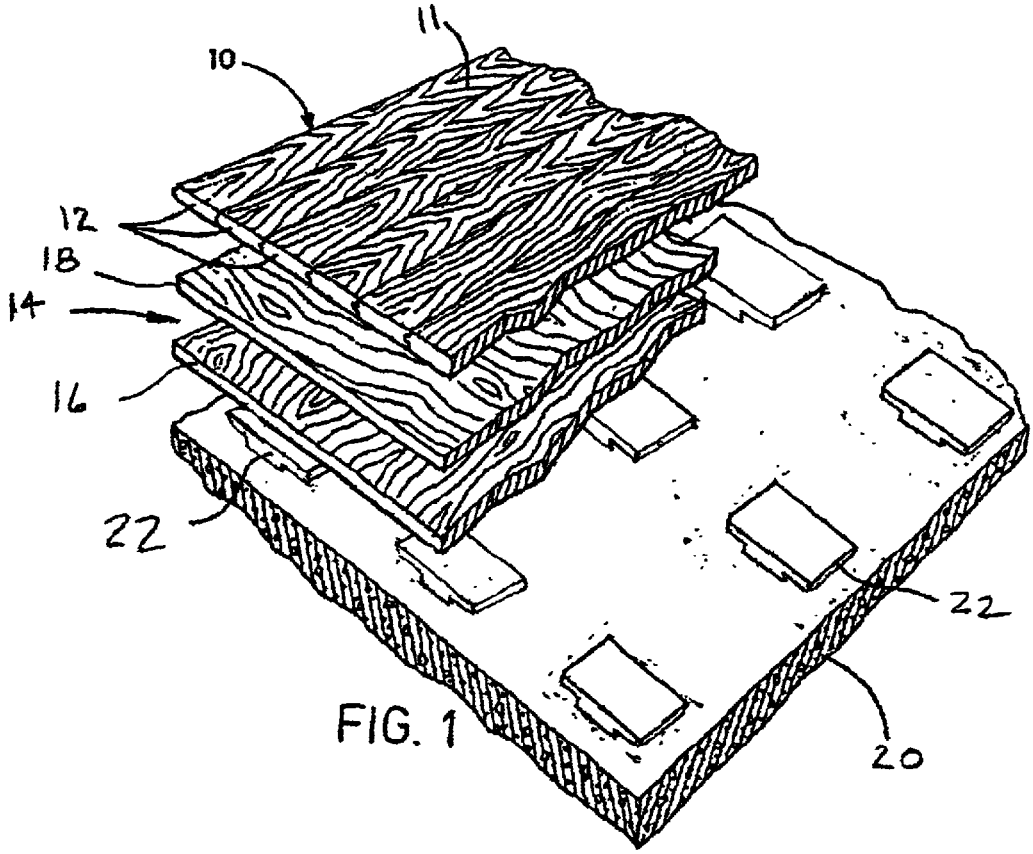
FIG. 1 is an exploded, perspective view of a sports floor utilizing a shock absorber constructed in accordance with the present invention.

Referring now to the drawings and, more particularly, to FIG. 1, a floor assembly 10 having a playing surface 11 made out of strips of wood 12 is illustrated therein. The floor assembly 10 illustrated is the type that would be suitable for playing basketball. The strips of wood 12 are typically manufactured from maple or other suitable wood. Resting directly under and in contact with the underside of the playing surface 11 is a sub-flooring 14. The sub-flooring 14 typically includes a first layer of plywood 16 and a second layer of plywood 18. The first layer of plywood 16 is often oriented in one direction while the second layer of plywood 18 is oriented in a second direction which is often 45° (not shown) or 90° (FIG. 1) relative to the first direction. A cement slab is generally provided as a rigid support base 20 for the playing surface 11 and the sub-flooring 14.

A plurality of shock absorbers 22 constructed in accordance with the present invention are illustrated supporting the sub-flooring 14 in a spaced apart relation with respect to the base 20. The shock absorbers 22 are connected to the bottom surface of the first layer of plywood 16 at an equal center-to-center distance. For a basketball court, the shock absorbers 22 are generally required to be spaced at $9^{13/16}$ inch center-to-center intervals, by way of example. For a multi-purpose floor, the shock absorbers 22 would generally be required to be spaced at twelve inch center-to-center intervals to provide additional flex in the playing surface.

Figure 2:
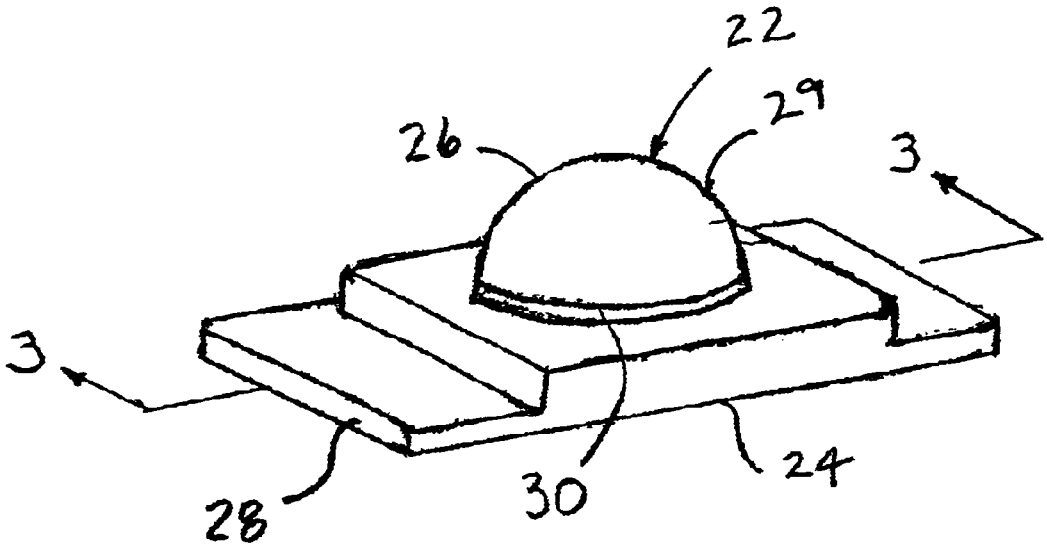
FIG. 2 is a perspective view of the shock absorber of the present invention.
Figure 3:
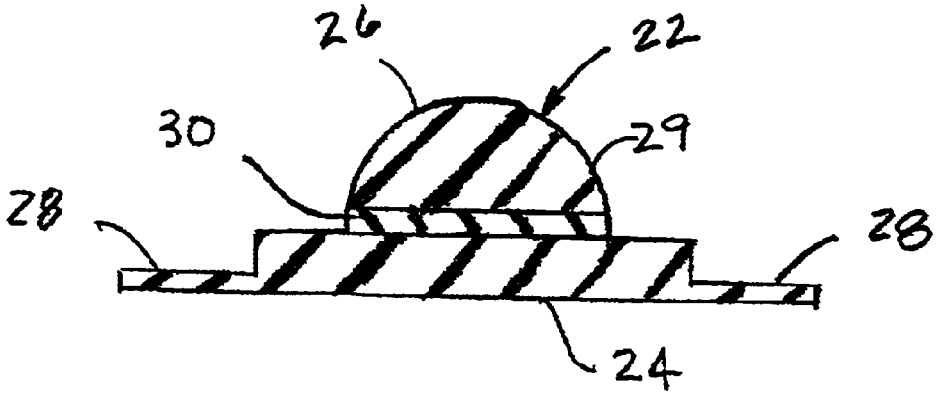
FIG. 3 is a cross-section taken along line 3—3 of FIG. 2.

Referring now to FIGS. 2 and 3, each of the shock absorbers 22 has a base portion 24 and a nodule portion 26. The base portion 24 has a substantially square configuration. The base portion 24 is provided with a pair of connector tabs 28 are formed to extend from opposing ends of the base portion 24 to facilitate attachment of the shock absorber 22 to the sub-flooring 14 with a fastener, such as a staple.

The nodule portion 26 is centrally formed on the base portion 24 so as to have a diameter less than the base portion 24. The nodule portion 26 is shown in FIGS. 2 and 3 to have a substantially semi-spherical shape. However, it will be appreciated that the nodule portion 26 can be configured to have a variety of different geometric shapes depending on the desired floor characteristics. For example, the nodule portion 26 may be configured to have a pyramidal shape.

The shock absorber 22 is formed into a one piece unit using conventional manufacturing processes, such as vulcanization, and can be formed from a variety of elastomeric materials, such as rubber, PVC, neoprene, nylon, or polyurethane. As discussed above, high durometer (hard) resilient shock absorbers produce a floor having preferred ball response characteristics; however, hard shock absorbers provide low shock absorption, and thus have a greater potential to cause harm to the athlete. Yet, floors employing soft shock absorbers do not produce desirable ball response characteristics. To this end, the base portion 24 is preferably formed of a material having a durometer Shore hardness of approximately 60–70A. Desirable results have been obtained by using a polyurethane having a durometer Shore hardness of 68A.

A substantial portion of the nodule portion 26 is formed to have a durometer Shore hardness the same as the base portion 24 while the remaining portion of the nodule portion 26 is formed to have a durometer Shore hardness less than the base portion 24. More specifically, the nodule portion 26 is formed to have a first layer 29 and a second layer 30. The first layer 29 of the nodule portion 26 is formed of an elastomeric material having a durometer Shore hardness substantially equal to the durometer Shore hardness of the base portion 24, and the second layer 30 is formed of an elastomeric material having a durometer Shore hardness less than the durometer Shore hardness of the base portion 24 and the first layer 29 of the nodule portion 26. In the embodiment illustrated herein, the second layer 30 of the nodule portion 26 is a relatively thin section of the nodule portion 26 formed immediately adjacent to the base portion 24. The second layer 30 is preferably formed of a material having a durometer Shore hardness of approximately 40–50A. By way of example, suitable results have been obtained when the second layer 30 is formed of a polyurethane material having a durometer Shore hardness of approximately 45A.

The DIN standards were developed in Germany and are recognized world wide as the best method for evaluating sports floors. The standards were developed to ensure that aerobic athletes received the greater degree of safety and performance from a flooring surface when participating in aerobic exercise. There are four basic testing areas under the DIN standards. These areas are: area deflection, vertical deflection, shock absorption, and ball deflection. Area deflection measures the floor system's ability to contain the deflected area under an athlete's impact, measured within twenty inches of the impacted area. Vertical deflection measures the floor system's downward movement during the impact of an athlete landing on the surface. This measurement is interdependent with area deflection criteria. Shock absorption measures the floor system's ability to absorb impact forces normally absorbed by the athlete when landing on a hard surface such as concrete or asphalt. Finally, ball deflection measures the ball's response off the sports floor system as compared to the ball's response off concrete.

The second layer 30 of the nodule portion 26 is sized so that in combination with the base portion 24 and the first layer 29 of the nodule portion 26, the shock absorber 22 provides the desired shock absorbing characteristics that cause the floor assembly 10 to absorb a significant percentage of the impact force of an individual's foot while maintaining a firmness which controls the deformation of the playing surface results in a desirable ball response off the playing surface. By way of example, the shock absorber 22 (including the connector tabs 28) may have overall dimensions of approximately 2.50 inches×1.50 inches×0.75 inches with the dimensions of the base portion 24 being approximately 1.50 inches×1.50 inches×0.25 inches, the dimensions of the first layer 29 of the nodule portion 26 having a diameter of approximately 0.9375 inches and a thickness of approximately 0.40 inches, and the dimensions of the second layer 30 of the nodule portion 26 having a diameter of approximately 1.00 inch and a thickness of approximately 0.10 inches. It should be understood that the second layer 30 of the nodule portion 30 can be formed to have any thickness that provides the desired floor characteristics.

Two test pods incorporating the shock absorber 22 described above were tested by United States Sports Surfacing Laboratory, Inc. utilizing the test methods described in the DIN 18032.2 (1991) Standard. The first test pod (TEST POD #3) had the shock absorbers 22 spaced at twelve inches, and the second test pod (TEST POD #4) had the shock absorbers 22 spaced and 9.81 inches. The results of those tests are as follows:

Test Pod #3

| Test Surface/ Test Point | Force Reduction unit: % req: min 53 | Standard Deformation unit: mm req: min 2.3 | W500 across unit: % req: max 15 | W500 along unit: % req. max 15 | Rolling Load unit: N req: 1500 | Ball Rebound unit: % req: min 90 |
|---|---|---|---|---|---|---|
| 1 | 59 | 2.3 | 9.8 | 20.0 | 1500 | 93 |
| 2 | 57 | 2.4 | 8.3 | 19.9 | | 91 |
| 3 | 63 | 2.8 | 9.5 | 21.3 | | 91 |
| 4 | 58 | 2.4 | 6.3 | 16.3 | | 93 |
| 5 | 63 | 2.8 | 3.7 | 16.7 | | 91 |
| 6 | 62 | 2.7 | 8.0 | 24.7 | | 91 |
| Average | 60 | 2.6 | 7.6 | 19.8 | 1500 | 92 |

Test Pod #4

| Test Surface/ Test Point | Force Reduction unit: % req: min 53 | Standard Deformation unit: mm req: min 2.3 | W500 across unit: % req: max 15 | W500 along unit: % req. max 15 | Rolling Load unit: N req: 1500 | Ball Rebound unit: % req: min 90 |
|---|---|---|---|---|---|---|
| 1 | 60 | 2.7 | 6.5 | 14.9 | 1500 | 93 |
| 2 | 59 | 2.4 | 5.8 | 15.2 | | 93 |
| 3 | 50 | 1.9 | 6.0 | 11.6 | | 97 |
| 4 | 54 | 1.8 | 3.9 | 15.0 | | 95 |
| 5 | 57 | 2.3 | 7.7 | 14.7 | | 97 |
| 6 | 61 | 3.0 | 7.0 | 18.9 | | 93 |
| Average | 57 | 2.4 | 6.2 | 15.0 | 1500 | 95 |

From the above description it is clear that the present invention is well adapted to carry out the objects and to attain the advantages mentioned herein as well as those inherent in the invention. While a presently preferred embodiment of the invention has been described for purposes of this disclosure, it will be understood that numerous changes may be made which will readily suggest themselves to those skilled in the art and which are accomplished within the spirit of the invention disclosed and as defined in the appended claims.

What is claimed is:

1. A shock absorber for a floor assembly, comprising:

a base portion having a first side and an opposing second side, the base portion formed of an elastomeric material having a durometer Shore hardness, the base portion connectable to a sub-flooring of the floor assembly with the second side positioned adjacent to the sub-flooring; and a nodule portion extending a distance from the first side of the base portion, the nodule portion having a first layer formed of an elastomeric material having a durometer Shore hardness substantially equal to the durometer Shore hardness of the base portion and a second layer formed of an elastomeric material having a durometer Shore hardness less than the durometer Shore hardness of the base portion and the first layer of the nodule portion.

2. The shock absorber of claim 1 wherein the second layer of the nodule portion is positioned between the base portion and the first layer of the nodule portion.

3. The shock absorber of claim 2 wherein the second layer of the nodule portion is positioned immediately adjacent the base portion.

4. The shock absorber of claim 1 wherein the base portion as a substantially square configuration.

5. The shock absorber of claim 4 further comprising a pair of connector tabs extending from the base portion to facilitate attachment of the shock absorber to the sub-flooring.

6. The shock absorber of claim 1 wherein the durometer Shore hardness of the base portion and the first layer of the nodule portion is in a range of approximately 60–70A.

7. The shock absorber of claim 1 wherein the durometer Shore hardness of the second layer of the nodule portion is in a range of approximately 40–50A.

8. The shock absorber of claim 7 wherein the durometer Shore hardness of the second layer of the nodule portion is in a range of approximately 40–50A.

9. A floor assembly, comprising:

a plurality of strips of material cooperating to form a floor surface;

a sub-flooring positioned beneath the strips of material to support the strips of material; and a plurality of shock absorbers positioned between the sub-flooring and a rigid support base to support the sub-flooring in a spaced apart relation with respect to the rigid support base, each of the shock absorbers comprising:

a base portion having a first side and an opposing second side, the base portion formed of an elastomeric material having a durometer Shore hardness; and a nodule portion extending a distance from the first side of the base portion, the nodule portion having a first layer formed of an elastomeric material having a durometer Shore hardness substantially equal to the durometer Shore hardness of the base portion and a second layer formed of an elastomeric material having a durometer Shore hardness less than the durometer Shore hardness of the base portion and the first layer of the nodule portion.

10. The floor assembly of claim 9 wherein the second layer of the nodule portion of the shock absorber is positioned between the base portion and the first layer of the nodule portion.

11. The floor assembly of claim 10 wherein the second layer of the nodule portion is positioned immediately adjacent the base portion.

12. The floor assembly of claim 9 wherein the base portion has a substantially square configuration.

13. The floor assembly of claim 9 wherein each of the shock absorbers is connected to the sub-flooring of the floor assembly with the second side of the base portion positioned adjacent to the sub-flooring.

14. The floor assembly of claim 9 wherein each of the shock absorbers further comprises a pair of connector tabs extending from the base portion, the connector tabs are connected to the sub-flooring with the second side of the base portion positioned adjacent to the sub-flooring.

15. The floor assembly of claim 9 wherein the durometer Shore hardness of the base portion and the first layer of the nodule portion is in a range of approximately 60–70A.

16. The floor assembly of claim 9 wherein the durometer Shore hardness of the second layer of the nodule portion is in a range of approximately 40–50A.

17. The floor assembly of claim 15 wherein the durometer Shore hardness of the second layer of the nodule portion is in a range of approximately 40–50A.

18. The floor assembly of claim 9 wherein the durometer Shore hardness of the base portion and the first layer of the nodule portion is approximately 68A.

19. The floor assembly of claim 9 wherein the durometer Shore hardness of the second layer of the nodule portion is approximately 45A.

20. The floor assembly of claim 19 wherein the durometer Shore hardness of the second layer of the nodule portion is approximately 45A.

21. A floor assembly, comprising:

a plurality of strips of material cooperating to form a playing surface;

a sub-flooring positioned beneath the strips of material to support the strips of material; and a plurality of shock absorbers positioned between the sub-flooring and a rigid support base to support the sub-flooring in a spaced apart relation with respect to the rigid support base, each of the shock absorbers comprising:

a base portion having a first side and an opposing second side, the base portion formed of an elastomeric material having a durometer Shore hardness; and a nodule portion extending a distance from the first side of the base portion, the nodule portion having a first layer formed of an elastomeric material having a durometer Shore hardness substantially equal to the durometer Shore hardness of the base portion and a second layer formed of an elastomeric material having a durometer Shore hardness less than the durometer Shore hardness of the base portion and the first layer of the nodule portion, wherein the strips of wood, the sub-flooring, and the shock absorbers cooperate to provide the floor assembly with shock absorbing characteristics that enable the floor assembly to absorb at least about fifty-three percent of an impact force applied to the playing surface while maintaining a firmness that limits vertical deflection of the playing surface to be at most about 2.3 mm and produces a ball response off the playing surface of at least about ninety percent.

22. The floor assembly of claim 21 wherein the second layer of the nodule portion of the shock absorber is positioned between the base portion and the first layer of the nodule portion.

23. The floor assembly of claim 22 wherein the second layer of the nodule portion is positioned immediately adjacent the base portion.

24. The floor assembly of claim 21 wherein each of the shock absorbers further comprises a pair of connector tabs extending from the base portion, the connector tabs are connected to the sub-flooring with the second side of the base portion positioned adjacent to the sub-flooring.

25. The floor assembly of claim 21 wherein the durometer Shore hardness of the base portion and the first layer of the nodule portion is in a range of approximately 60–70A.

26. The floor assembly of claim 21 wherein the durometer Shore hardness of the second layer of the nodule portion is in a range of approximately 40–50A.

27. The floor assembly of claim 26 wherein the durometer Shore hardness of the second layer of the nodule portion is in a range of approximately 40–50A.

28. The floor assembly of claim 21 wherein the durometer Shore hardness of the base portion and the first layer of the nodule portion is in a range of approximately 68A.

29. The floor assembly of claim 21 wherein the durometer Shore hardness of the second layer of the nodule portion is approximately 45A.

30. The floor assembly of claim 29 wherein the durometer Shore hardness of the second layer of the nodule portion is approximately 45A.

31. A shock absorber for a floor assembly, comprising:

a base portion having a first side and an opposing second side, the base portion formed of an elastomeric material having a durometer Shore hardness, the base portion connectable to a sub-flooring of the floor assembly with the second side positioned adjacent to the sub-flooring; and a nodule portion extending a distance from the first side of the base portion, the nodule portion having a first layer formed of an elastomeric material having a durometer Shore hardness and a second layer formed of an elastomeric material having a durometer Shore hardness that is different from the durometer Shore hardness of the base portion and the first layer of the nodule portion.

32. The shock absorber of claim 31 wherein the second layer of the nodule portion is positioned between the base portion and the first layer of the nodule portion.

33. The shock absorber of claim 32 wherein the second layer of the nodule portion is positioned immediately adjacent the base portion.

* * * * *